US011613032B2

(12) United States Patent
Isenschmid

(10) Patent No.: US 11,613,032 B2
(45) Date of Patent: Mar. 28, 2023

(54) SHEARING HEAD FOR AN ANIMAL SHEARING MACHINE AND AN ANIMAL SHEARING MACHINE

(71) Applicant: Heiniger AG, Herzogenbuchsee (CH)

(72) Inventor: Reto Isenschmid, Bolken (CH)

(73) Assignee: HEINIGER AG, Herzogenbuchsee (CH)

( * ) Notice: Subject to any disclaimer, the term of this patent is extended or adjusted under 35 U.S.C. 154(b) by 15 days.

(21) Appl. No.: 17/364,123

(22) Filed: Jun. 30, 2021

(65) Prior Publication Data

US 2022/0009113 A1 Jan. 13, 2022

(30) Foreign Application Priority Data

Jul. 13, 2020 (CH) ..... 855/20

(51) Int. Cl.
*B26B 19/38* (2006.01)
*B26B 19/06* (2006.01)
*B26B 19/24* (2006.01)

(52) U.S. Cl.
CPC ..... *B26B 19/3886* (2013.01); *B26B 19/063* (2013.01); *B26B 19/24* (2013.01)

(58) Field of Classification Search
CPC ..... B26B 19/24; B26B 19/063; B26B 19/06; B26B 19/3886; B26B 19/20; A01K 14/00
USPC ..... 30/221, 222
See application file for complete search history.

(56) References Cited

U.S. PATENT DOCUMENTS 480,997 A * 8/1892 Burgon ..... B26B 19/24 30/222
494,034 A * 3/1893 Silver ..... B26B 19/24 30/222
579,811 A * 3/1897 Stewart ..... B26B 19/24 30/222
RE12,131 E * 7/1903 Palmer ..... 30/222
888,867 A * 5/1908 Cahill ..... B26B 19/24 30/222
1,046,323 A * 12/1912 Neighbour ..... B26B 19/24 30/222

(Continued)

FOREIGN PATENT DOCUMENTS

AU 509163 4/1978
CH 661242 A * 7/1987 ..... B26B 19/24

(Continued)

OTHER PUBLICATIONS

CH661242 English Translation; Horisberger, Alfred; B26B19/24; Nov. 18, 1983.*

*Primary Examiner* — Laura M Lee
(74) *Attorney, Agent, or Firm* — Pearne & Gordon LLP

(57) ABSTRACT

A shearing head for an animal shearing machine, comprising an upper blade and a lower blade, whereby the upper blade is movable relative to the lower blade. A pressure control device, comprising a rotatable control knob, with which the pressure of the upper blade on the lower blade is settable. The pressure control device further comprises a pressure indicator pin disposed coaxially with respect to the control knob and movable in a translational way. The pressure indicator pin is at least partially visible to a user of the shearing head and the axial position of the pressure indicator pin relative to the control knob is dependent upon the pressure of the upper blade on the lower blade set with the pressure control device.

10 Claims, 7 Drawing Sheets

(56) References Cited

U.S. PATENT DOCUMENTS

| | | | | | |
|---|---|---|---|---|---|
| 1,582,324 | A * | 4/1926 | Winfreds | B26B 19/24 | 30/225 |
| 1,602,237 | A * | 10/1926 | Martin | B26B 19/24 | 30/221 |
| 1,692,870 | A * | 11/1928 | Scott | B26B 19/24 | 30/222 |
| 1,871,700 | A * | 8/1932 | Jeppsson | B26B 19/24 | 30/216 |
| 2,268,035 | A * | 12/1941 | Jepson | B26B 19/24 | 30/221 |
| 2,651,107 | A * | 9/1953 | Bartlett | B26B 19/24 | 30/221 |
| 2,714,763 | A * | 8/1955 | Jepson | B26B 19/24 | 30/221 |
| 4,291,462 | A * | 9/1981 | Corder | B26B 19/24 | 30/221 |
| 7,762,000 | B2 * | 7/2010 | Williams | A01K 14/00 | 30/223 |
| 7,975,387 | B2 * | 7/2011 | Mikula | B26B 19/20 | 30/233 |
| 8,341,846 | B1 * | 1/2013 | Holmes | B26B 19/20 | 30/208 |
| 10,391,646 | B2 * | 8/2019 | Holmes | B25B 23/1427 | |
| 10,843,353 | B2 * | 11/2020 | Phoon | B26B 19/20 | |

FOREIGN PATENT DOCUMENTS

| | | |
|---|---|---|
| FR | 1542796 | 10/1968 |
| GB | 509163 | 7/1939 |

* cited by examiner

FIG. 3
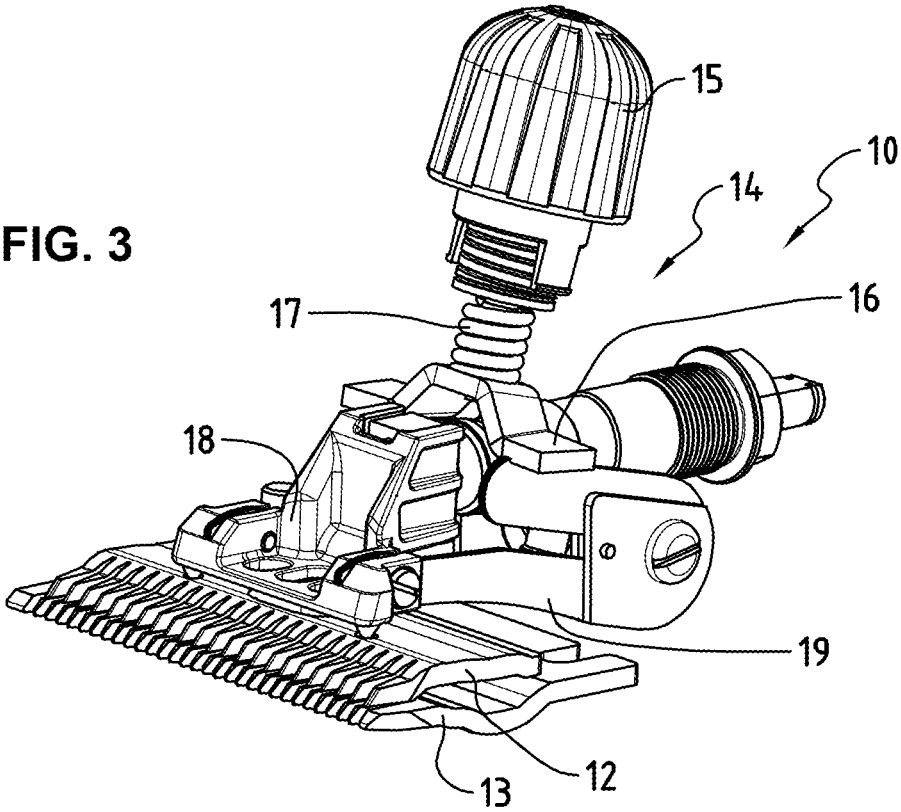
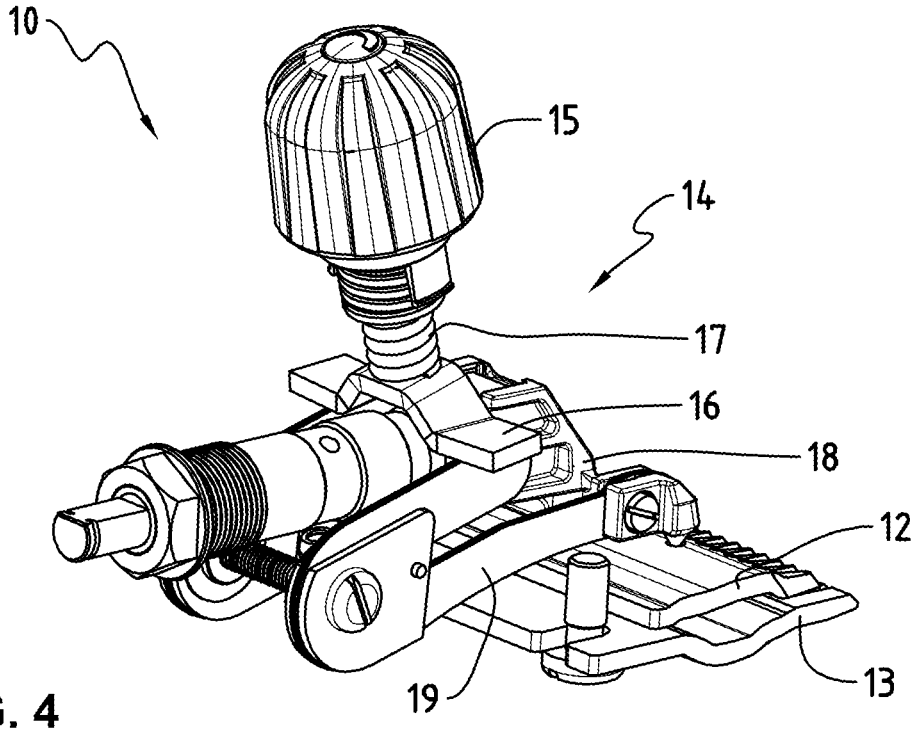
FIG. 4

SHEARING HEAD FOR AN ANIMAL SHEARING MACHINE AND AN ANIMAL SHEARING MACHINE

TECHNICAL FIELD OF THE INVENTION

The present invention relates to the technical field of animal shearing machines, in particular livestock shearing machines, such as, for example, horse shearing machines. The invention relates especially to a shearing head for an animal shearing machine, comprising a pressure control device for setting a pressure with which an upper blade presses on a lower blade, whereby the pressure control device has a pressure indicator pin for indicating the set pressure. The present invention also relates moreover to an animal shearing machine comprising a shearing head according to the present invention.

STATE OF THE ART

Animal shearing machines are known in a multiplicity of embodiments. Most comprise a shearing hand piece for holding of the machine by the user and a shearing head for the actual shearing of the animal. The shearing head normally has two blades, designated as upper blade and lower blade, which move relative to one another, in order to generate the cutting effect. Modern animal shearing machines have a shearing head detachable from the hand piece. This makes possible, on the one hand, the simple cleaning of the shearing head, and, on the other hand, the replacement of a defective shearing head. The shearing machine has a motor, usually an electric motor for driving the blades.

With conventional animal shearing machines, the upper and lower blades move in a translational way relative to one another. Such shearing machines are known, for example, from the British patent application GB 509163 B2, from the Australian patent AU509163 B2 or from the French patent application FR1542796. All these machines have a pressure control device with a rotatable control knob for the setting of the pressure of the upper blade on the lower blade. The setting or subsequent adjustment of the pressure is necessary, since in the course of the shearing the blades become duller and duller. One tries to counteract this with the setting of a greater pressure in order to keep the cutting quality constant during several shearing operations.

Nevertheless the pressure of the upper blade on the lower blade cannot be set as high as desired. When the pressure becomes too great, very high friction levels arise between the blades, which leads to a heating up of the blades. Too great a temperature increase of the blades is undesirable since the shearing of the animals thereby becomes unpleasant and the shearing machine itself can also suffer from this.

The user of known animal shearing machines therefore needs a great amount of experience in order to always set the correct pressure. Since, as a rule, no indicator is present to indicate the number of rotations that have been carried out so far on the rotatable control knob, the user must note this in order to know the pressure actually set. With very long shearing operations, such as, for example, the shearing of many animals, it is not uncommon for the user to simply forget the pressure setting with the risk of setting too high a shearing pressure.

In none of the known animal shearing machines is a shearing pressure indicator provided thanks to which the current pressure of the upper blade on the lower blade can be indicated. As explained above, such an indicator would have many advantages.

Starting from the state of the art, the present invention has as its object therefore to overcome mentioned disadvantages and to propose a shearing head for an animal shearing machine as well as an animal shearing machine, with which the pressure of the upper blade on the lower blade is always able to be determined.

SUMMARY OF INVENTION

These objects are achieved according to the present invention above all through the features of the independent claim. Further advantageous embodiments follow moreover from the dependent claims and the description.

In particular the objects of the present invention are achieved through a shearing head for an animal shearing machine comprising an upper blade and a lower blade, whereby the upper blade is movable relative to the lower blade, a pressure control device, comprising a rotatable control knob, with which the pressure of the upper blade on the lower blade is settable, whereby the pressure control device comprises a pressure indicator pin disposed coaxially with respect to the control knob and movable in a translational way, whereby the pressure indicator pin is at least partially visible to a user of the shearing head and whereby the axial position of the pressure indicator pin relative to the control knob is dependent upon the pressure of the upper blade on the lower blade set with the pressure control device.

From the position of the pressure indicator pin the user can determine information about the set pressure between upper blade and lower blade. The user can thus recognize when the set pressure has reached a critical range in which friction between upper blade and lower blade can cause great temperature increase. Above and beyond this, the user can determine when a replacement or a re-sharpening of the blades becomes necessary.

In a first preferred embodiment of the present invention, the pressure control device comprises a pressure bracket co-operating with the upper blade, a control knob spindle connected to the control knob, a pressure bracket spring disposed between control knob spindle and pressure bracket and a spacer screw disposed coaxially with respect to the control knob spindle and freely movable in a translational way, whereby through adjustment of the distance between control knob spindle and pressure bracket the pressure of the upper blade on the lower blade is settable and whereby a first end of the spacer screw is connected to the pressure bracket and a second end of the spacer screw cooperates with the pressure indicator pin in such a way that a displacement of the spacer screw with respect to the control knob spindle brings about a shift of the pressure indicator pin. The shift of the pressure indicator pin can thereby be translated in an especially simple way as the reaction to the adjustment of the pressure of the upper blade on the lower blade.

In another preferred embodiment of the present invention, a reinforcement means is provided between the second end of the spacer screw and the pressure indicator pin, with which reinforcement means a small displacement of the spacer screw is translated into a greater shift of the pressure indicator pin. This is advantageous since the various elements move only a little between their position at a low pressure and their position at a maximal pressure, typically a few millimeters. Thanks to the reinforcement means this shift of the pressure is more recognizable to the user.

In another preferred embodiment of the present invention, the reinforcement means comprises a pusher and a lever positioned between pusher and pressure indicator pin, whereby the pusher is connected to the second end of the spacer screw and has an inclined surface with respect to the longitudinal axis of the spacer screw, whereby the inclination of the inclined surface of the pusher corresponds to the inclination of a surface of the opposite end of the pressure indicator pin and whereby the lever is fixed on the control knob in a way pivotable in relation to the longitudinal axis of the spacer screw. This mechanism makes it possible for the pressure indicator pin to move so far that the user is able to notice even a small pressure shift.

In still another preferred embodiment of the present invention, the pressure control device comprises locking means, by means of which the control knob is lockable in predetermined rotational positions. It can thereby be ensured that the control knob does not turn by itself, which would lead to an unintentional pressure shift.

In a further preferred embodiment of the present invention, the locking means comprise engagement elements, which are configured to co-operate with notches provided on the inner side of the control knob. This constitutes an especially simple embodiment of the locking means. The locking means give the user furthermore a haptic feedback that he has minimally increased the shearing pressure and that the cutting capacity of the blades should be better.

In still another preferred embodiment of the present invention, the outer surface of the pressure indicator pin is divided at least partially into a plurality of zones, whereby each zone corresponds to a pressure range for the pressure of the upper blade on the lower blade. The user can thereby recognize whether the set pressure is low, medium or high. A different classification is of course possible.

In another preferred embodiment of the present invention, each zone has a different color. The outer surface of the pressure indicator pin can thereby be designed in a kind of traffic light system with which the user is informed as to whether the set pressure is small, medium or critical.

In another preferred embodiment of the present invention, the upper blade is movable with respect to the lower blade in a translational way.

The objects of the present invention are also achieved moreover through an animal shearing machine comprising a shearing head according to the present invention.

Further details of the invention follow from the now following description of preferred embodiments of the invention which are represented in the attached drawings. The further advantages of the present invention can also be learned from the description as well as suggestions and proposals as to how the inventive subject matter could be changed or also further developed within the scope of what is being claimed.

BRIEF DESCRIPTION OF THE DRAWINGS

FIG. 3 shows a first perspective view of a shearing head with removed external casing and with low blade pressure according to the preferred embodiment of the present invention;

FIG. 4 shows a second perspective view of a shearing head with removed external casing and with low blade pressure according to the preferred embodiment of the present invention;

PREFERRED EMBODIMENTS OF THE INVENTION

Figure 1:
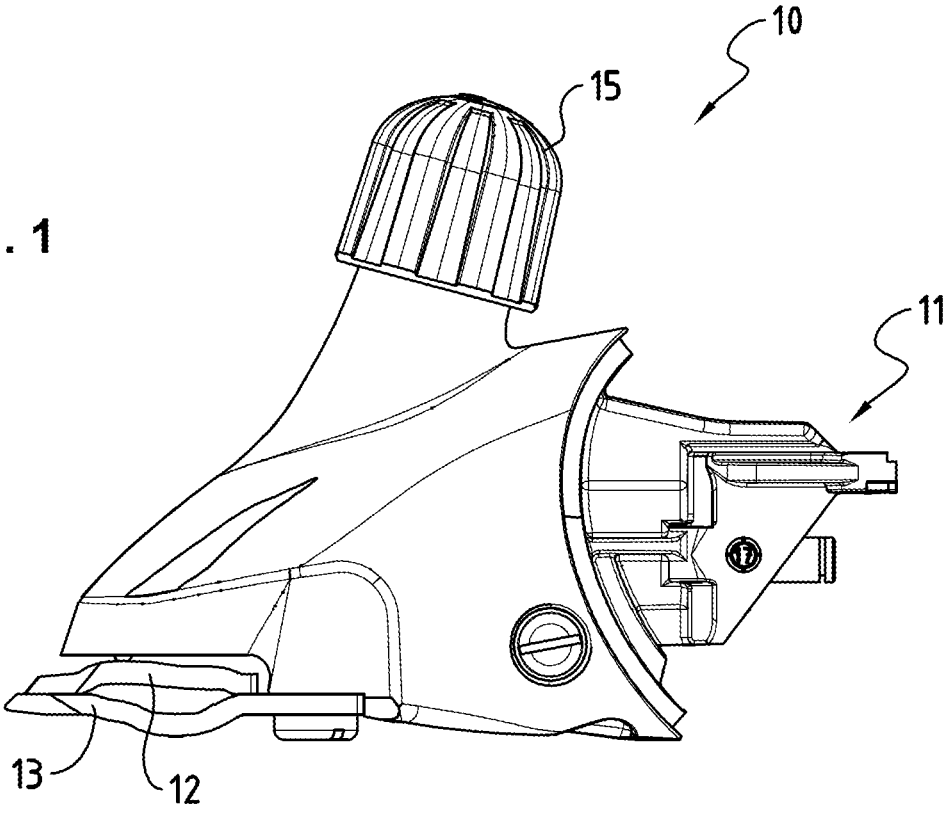
FIG. 1 shows a lateral view of a shearing head with low blade pressure according to a preferred embodiment of the present invention.
Figure 2:
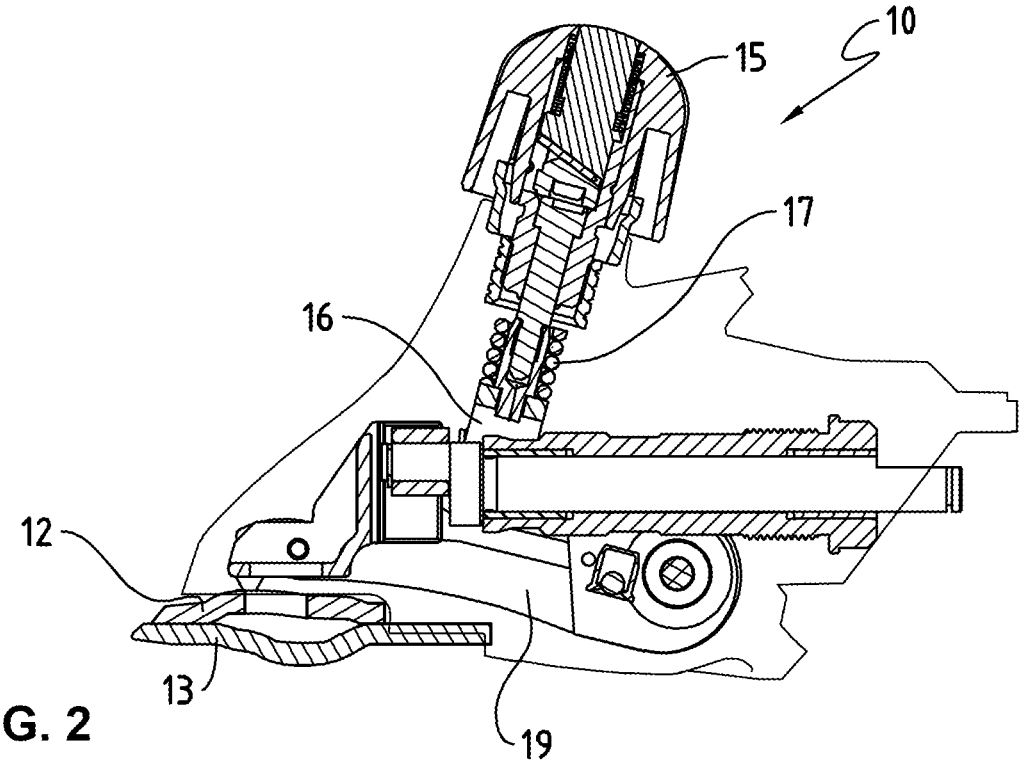
FIG. 2 shows a lateral sectional view of a shearing head with low blade pressure according to the preferred embodiment of the present invention.

FIGS. 1 and 2 show a lateral view and a lateral sectional view of a shearing head 10 for an animal shearing machine according to a preferred embodiment of the present invention. The shearing head 10 has coupling means 11 known from the state of the art for fixing on a shearing hand piece (not shown here). The shearing hand piece comprises a drive motor with which an upper blade 12 can be moved in a translational way relative to a lower blade 13. The coupling of the drive motor to the upper blade 12 is known to one skilled in the art, and will not be explained in detail here.

As can be seen in FIGS. 3 and 4, the shearing head 10 comprises a pressure control device 14 for the setting of the pressure of the upper blade 12 on the lower blade 13. The pressure control device 14 has a rotatable control knob 15, a pressure bracket 16, a pressure bracket spring 17, a pivot lever 18 and a leaf spring 19.

Figure 5:
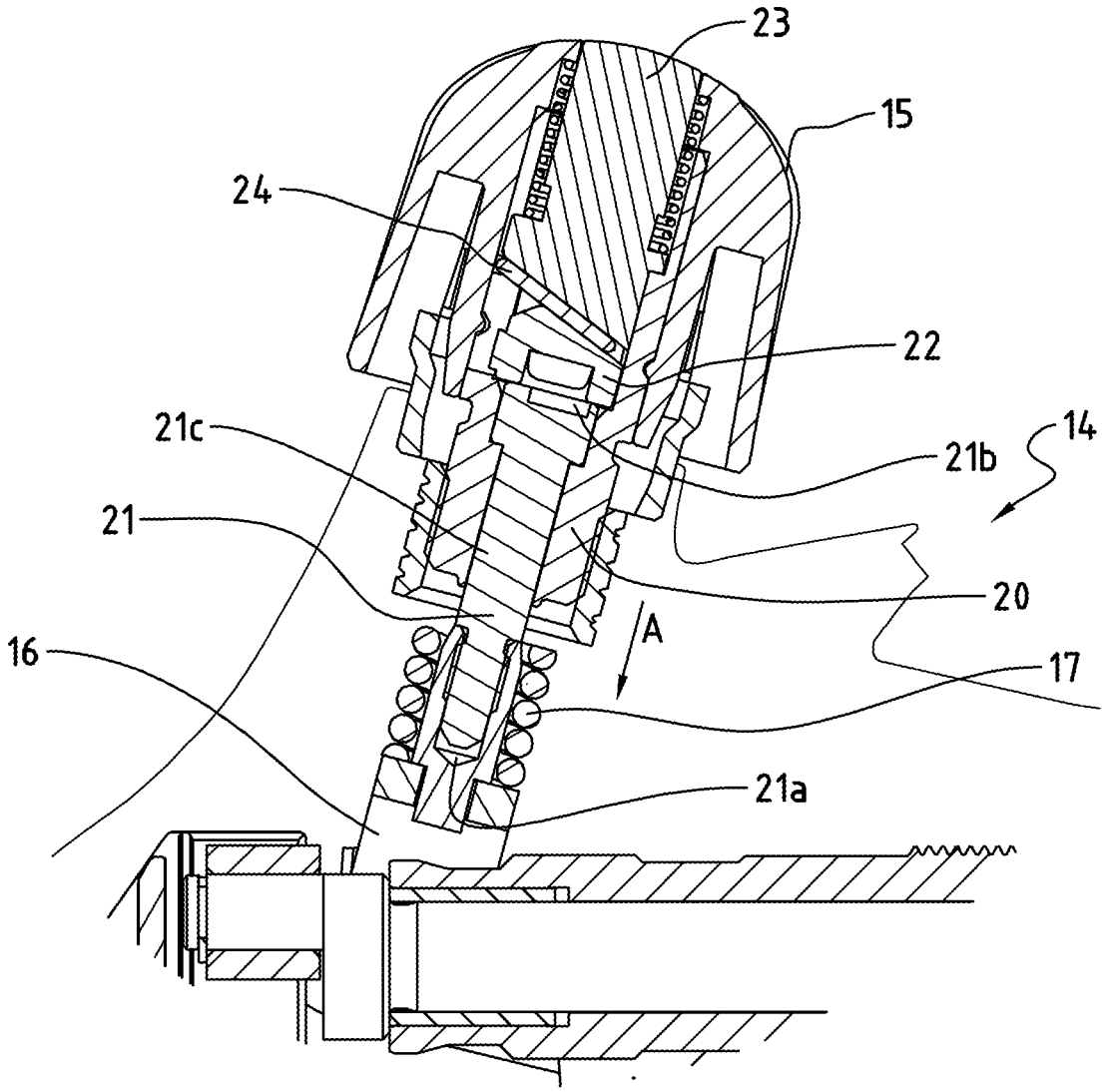
FIG. 5 shows a first detail view of FIG. 2.

The way of functioning of the pressure control device 14 can be understood best with reference to FIG. 5. Besides the already named elements, the pressure control device 14 also comprises a control knob spindle 20 connected to the control knob 15. Through the turning of the control knob 15, the spindle 20 can be moved in direction A (see arrow in FIG. 5) and the pressure bracket spring 17 can be compressed. A force is thereby generated in direction A on the pressure bracket 16, which via the leaf spring 19 and the pivot lever 18 leads to an increase of the pressure of the upper blade 12 on the lower blade. It is important to bear in mind that normally, and in contrast to what is shown in FIG. 5, there exists no spacing between spindle 20 and pressure bracket spring 17. The spacing shown in FIG. 5 is portrayed only for a better understanding of the way of functioning of the pressure control device 14.

Figure 6:
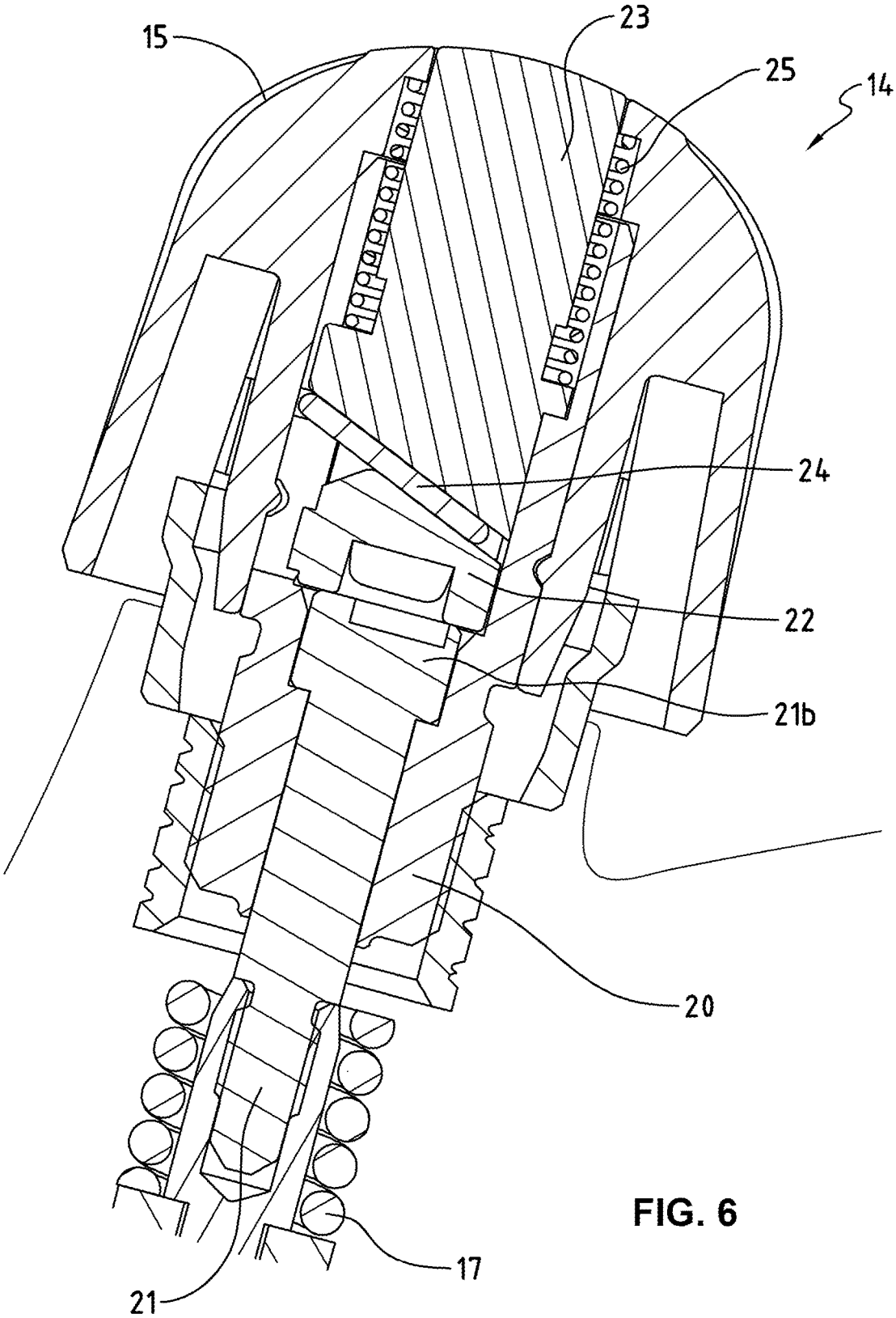
FIG. 6 shows a second detail view of FIG. 2.

As shown in FIG. 5, the pressure control device 14 also has a spacer screw 21, which has a first end 21*a* connectible to the pressure bracket 16. The spacer screw 21 is conceived in such a way that it is freely movable in a translational way along its longitudinal axis relative to the spindle 20. In other words, when the spindle 20 moves in direction A, the spacer screw 21 stays in place. The pressure control device 14 has furthermore a pusher 22 connected to a second end 21*b* of the spacer screw 21. The pusher 22 has an inclined surface with an inclination which corresponds to the inclination of a surface of the opposite end of a pressure indicator pin 23. Provided between pusher 22 and pressure indicator pin 23 is moreover a lever 24, which is fixed on the control knob 15 in a way pivotable in relation to the longitudinal axis of the spacer screw 21. Finally, an indicator pin spring 25 (see FIG. 6) is provided between pressure indicator pin 23 and control knob 15. The indicator pin spring 25 serves the purpose of resetting of the pressure indicator pin 23, when the shearing pressure is reduced. In addition, the indicator pin spring 25 ensures that the pressure indicator pin 23 remains in contact with the lever 24 and the pusher 22.

Figure 7:
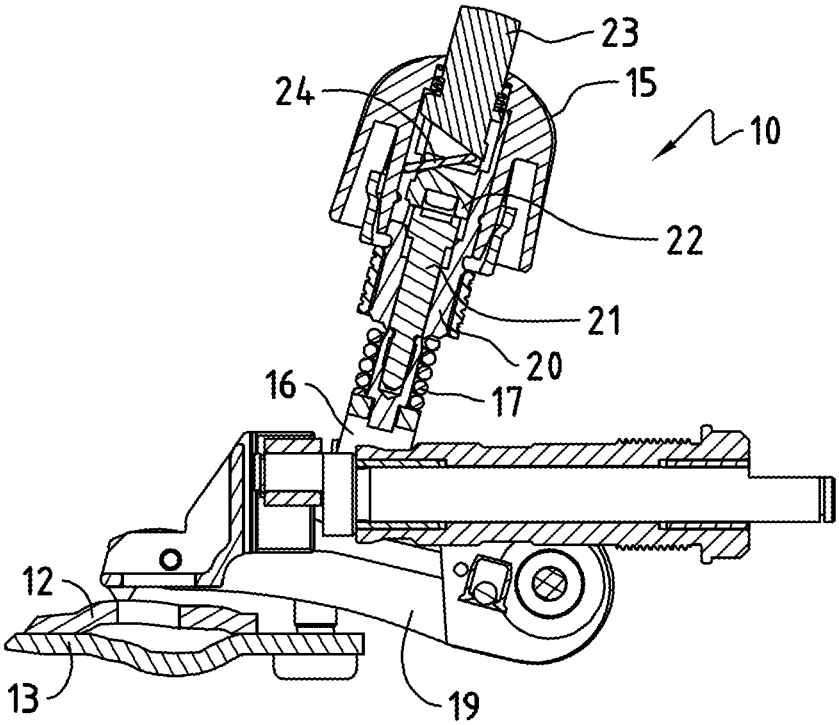
FIG. 7 shows a lateral sectional view of a shearing head with removed external casing and with high blade pressure according to the preferred embodiment of the present invention.
Figure 7A:
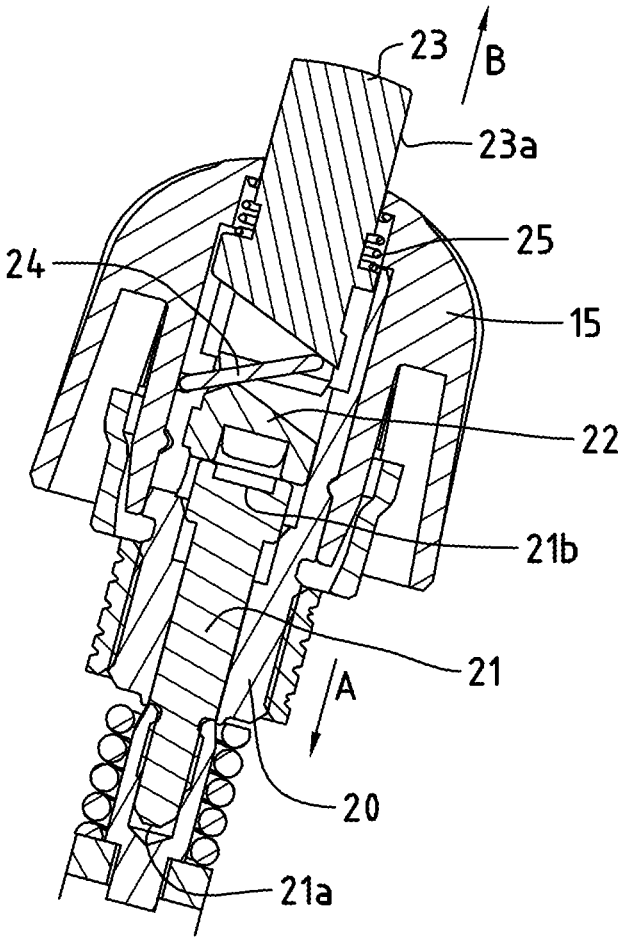
FIG. 7*a* shows a detail view of FIG. 7.

Now when the control knob 15 is turned, to increase the pressure of the upper blade 12 on the lower blade 13, the spindle 20 and with it the end of the lever 24 fixed on the control knob 15 are conveyed in direction A. As shown in FIGS. 7 and 7*a*, the displacement of the spindle 20 brings about a pivoting of the lever 24 and a shift of the pressure indicator pin 23 in direction B. An outer surface 23*a* of the pressure indicator pin 23 thereby becomes at least partially visible to the user. It is of course clear that the length of the pressure indicator pin 23, which is discernible to the user, depends on the set blade pressure. Thanks to the pressure control device 14, specifically thanks to the spacer screw 21, the pusher 22, the lever 24 and the pressure indicator pin 23, a means is available to the user which informs him about the set pressure. It is important to take into account that the pusher 22 with the lever 24 form a reinforcement means. Thanks to these elements, a small displacement of the spindle 20 relative to the spacer screw 21 is translated into a greater shift of the pressure indicator pin 23. This is advantageous since the spindle 20 is shifted between its position at a low blade pressure and its position at a maximal pressure only very little, typically a few millimeters.

Preferably the outer surface 23*a* of the pressure indicator pin 23 is divided into a multiplicity of zones, each zone corresponding to a pressure range for the pressure of the upper blade 12 on the lower blade 13. Each zone can have a different color, for example. In this way a kind of traffic light system can be provided with a green zone, which corresponds to a small pressure, with an orange zone for a medium pressure, and with a red zone for a critical pressure. Of course the zones can have different colors or the information about the amount of pressure can be presented differently, such as, for example, via numbers on the outer surface 23*a*.

It is important to note that even if the pusher 22 and lever 24 are advantageous, a pressure control device 14 according to the present invention can also provide for a direct connection between spacer screw 21 and pressure indicator pin 23.

Figure 8:
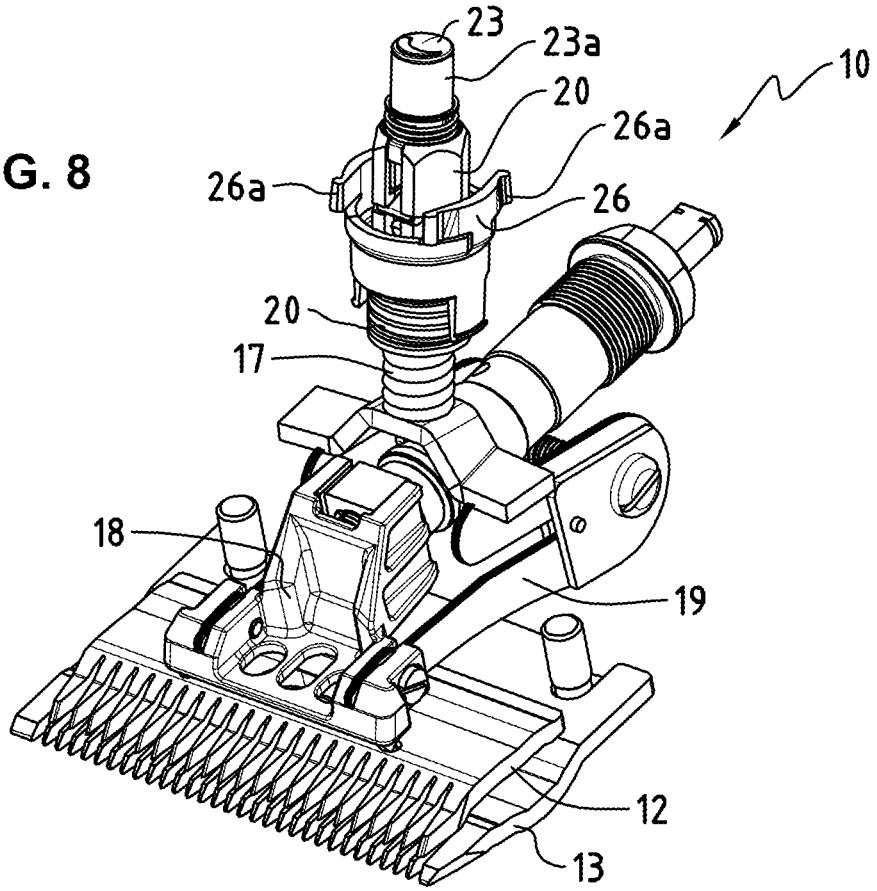
FIG. 8 shows a first perspective view of a shearing head with removed external casing and control knob according to the preferred embodiment of the present invention.
Figure 8A:
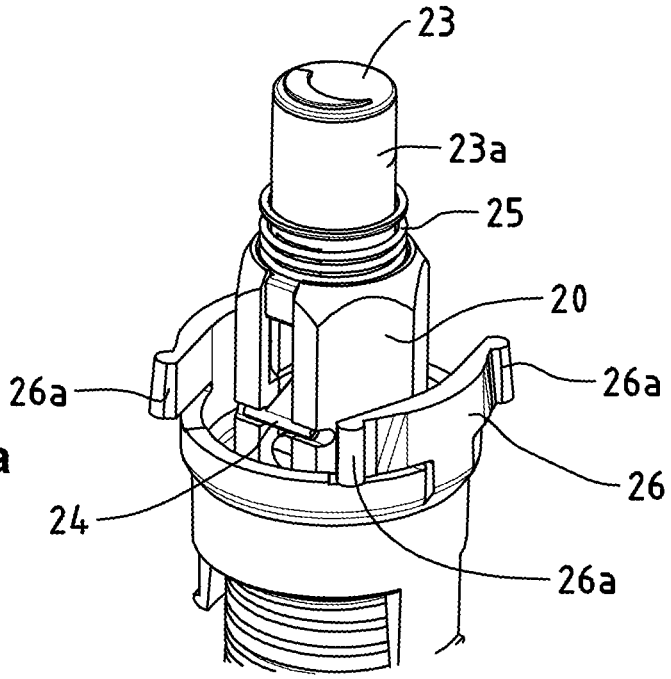
FIG. 8*a* shows a detail view of FIG. 8.
Figure 9:
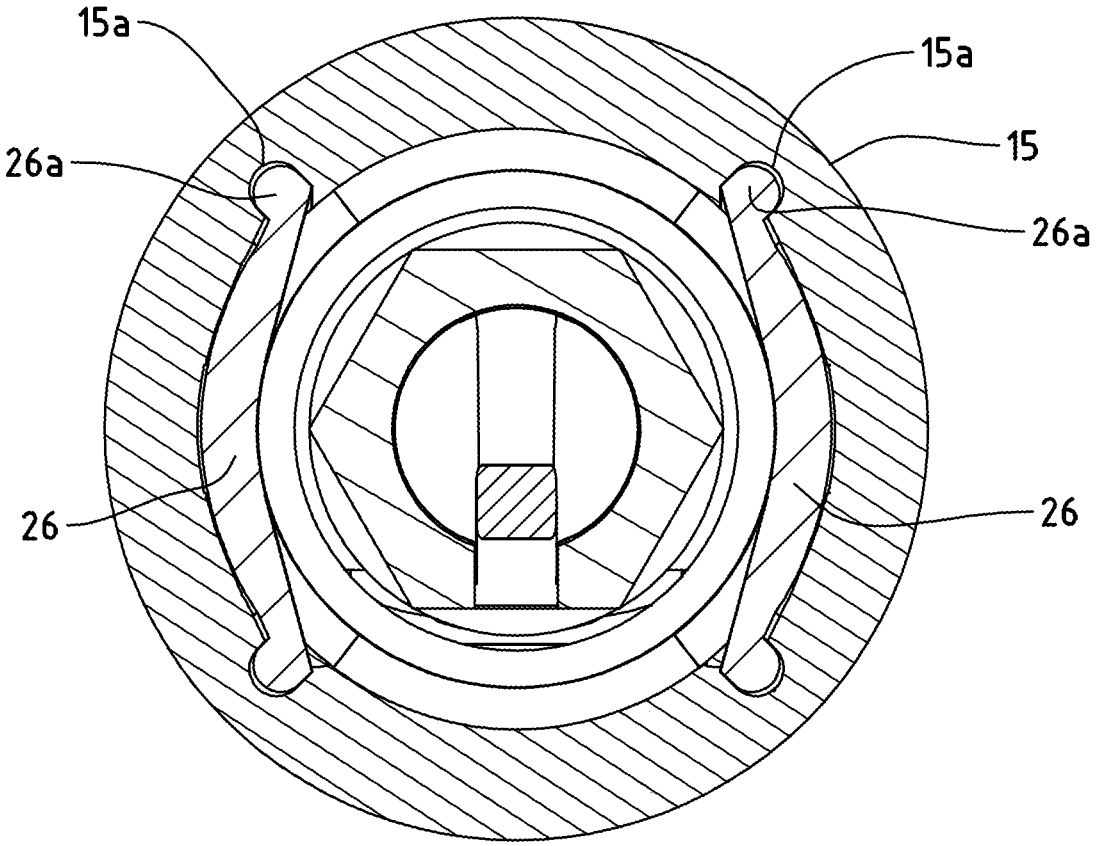
FIG. 9 shows the inner side of the control knob and the engagement elements of a shearing head according to the preferred embodiment of the present invention.

FIGS. 8 and 8*a* show the shearing head 10 with removed control knob 15. With the removal of the control knob 15, the engagement elements 26 become visible, with which the control knob 15 is lockable in predetermined rotational positions. As shown in FIG. 8 or 9, the engagement elements 26 have protrusions 26*a*, which co-operate with notches 15*a*, which are provided on the inner side of the control knob 15. Such engagement elements 26 have the advantage that they ensure that the rotational position of the control knob 15, and thus the blade pressure, remains constant during use of the shearing head 10 and even with strong vibrations.

In conclusion, it is to be pointed out again that embodiments described here by way of example represent only possibilities for implementation of the inventive concepts and should not be viewed as limiting in any way. One skilled in the art will understand that still other implementations for the invention and further elements are possible without losing sight of the essential features of the invention. In particular, one skilled in the art will easily understand that the present invention can also be used on a shearing head and a shearing machine with rotating blades. In this case, only the upper blade is able to move relative to the lower blade or both blades execute circular movements with differing rotational directions.

The invention claimed is:

1. Shearing head for an animal shearing machine, comprising an upper blade and a lower blade, wherein the upper blade is movable relative to the lower blade, a pressure control device, and a reinforcement;

the pressure control device comprising a rotatable control knob with which a pressure of the upper blade on the lower blade is settable, a pressure indicator pin disposed coaxially with respect to the control knob and movable in a translational way, and a spacer screw disposed coaxially with respect to the control knob and freely movable in a translational way; the reinforcement being disposed between the spacer screw and the pressure indicator pin; the reinforcement comprising a pusher and a lever, the lever being positioned between the pusher and the pressure indicator pin, the pusher being connected to the spacer screw and having an inclined surface with respect to a longitudinal axis of the spacer screw; the pressure indicator pin being at least partially visible to a user of the shearing head, an axial position of the pressure indicator pin relative to the control knob being dependent upon the pressure of the upper blade on the lower blade that is set with the pressure control device.

2. Shearing head according to claim 1, the pressure control device further comprising a pressure bracket cooperating with the upper blade, a control knob spindle connected to the control knob, and a pressure bracket spring disposed between the control knob spindle and the pressure bracket, wherein through adjustment of a distance between the control knob spindle and the pressure bracket the pressure of the upper blade on the lower blade is settable, and wherein a first end of the spacer screw is connected to the pressure bracket and a second end of the spacer screw cooperates with the pressure indicator pin such that a displacement of the spacer screw with respect to the control knob spindle brings about a shift of the pressure indicator pin.

3. Shearing head according to claim 2, wherein the reinforcement causes a displacement of the spacer screw with respect to the control knob spindle to be translated into a greater shift of the pressure indicator pin.

4. Shearing head according to claim 3, wherein an inclination of the inclined surface of the pusher corresponds to an inclination of an opposite surface of the pressure indicator pin and wherein the lever is fixed on the control knob in a way pivotable in relation to the longitudinal axis of the spacer screw.

5. Shearing head according to claim 1, the pressure control device further comprising locking means adapted to lock the control knob in predetermined rotational positions.

6. Shearing head according to claim 5, the locking means comprising engagement elements configured to cooperate with notches on an inner side of the control knob.

7. Shearing head according to claim 1, wherein an outer surface of the pressure indicator pin is divided at least partially into a plurality of zones, each said zone being assignable to a pressure range for the pressure of the upper blade on the lower blade.

8. Shearing head according to claim 7, each said zone having a different color.

9. Shearing head according to claim 1, the upper blade being movable with respect to the lower blade in a translational way.

10. Animal shearing machine comprising the shearing head according to claim 1.

* * * * *